US007775081B2

(12) United States Patent
Genereux et al.

(10) Patent No.: US 7,775,081 B2
(45) Date of Patent: Aug. 17, 2010

(54) ROTARY FILL MEMBER FOR A DIE ASSEMBLY

(75) Inventors: Joseph Pierre Genereux, Westland, MI (US); Diane Xu, Northville, MI (US)

(73) Assignee: Ford Motor Company, Dearborn, MI (US)

( * ) Notice: Subject to any disclaimer, the term of this patent is extended or adjusted under 35 U.S.C. 154(b) by 377 days.

(21) Appl. No.: 11/842,413

(22) Filed: Aug. 21, 2007

(65) Prior Publication Data

US 2009/0049879 A1 Feb. 26, 2009

(51) Int. Cl.
*B21D 55/00* (2006.01)
*B21J 9/18* (2006.01)

(52) U.S. Cl. ..... 72/452.5; 72/452.4; 72/20.3

(58) Field of Classification Search ..... 72/20.1, 72/20.3, 21.2, 386, 441, 446, 450, 451, 452.4, 72/452.5; 74/25, 579 E, 579 F, 579 R; 100/237, 100/282, 283
See application file for complete search history.

(56) References Cited

U.S. PATENT DOCUMENTS 4,228,706 A 10/1980 Borzym
5,231,860 A 8/1993 Tsuruta et al.
5,572,891 A * 11/1996 Klein et al. ..... 72/20.5
5,617,756 A 4/1997 Thudium et al.
5,934,125 A 8/1999 Takayama
6,606,941 B2 8/2003 Oen
6,662,067 B1 12/2003 Xu et al.
6,871,586 B2 3/2005 Teraoka
7,028,611 B2 4/2006 Nagae
2003/0116037 A1 6/2003 Tanaka et al.
2005/0145117 A1 7/2005 Du et al.

* cited by examiner

*Primary Examiner*—Dana Ross
*Assistant Examiner*—Teresa M Bonk
(74) *Attorney, Agent, or Firm*—Raymond L. Coppiellie; Brooks Kushman P.C.

(57) ABSTRACT

A rotary fill slide assembly for a sheet metal forming die that has a working element that performs an operation on a portion of a sheet metal blank. The rotary fill slide assembly has a motor that is controlled based upon a press cycle timing mechanism. The rotary fill slide is assembled to the die to fill a space adjacent to a portion of the blank when the blank is in position for the working element to perform the operation on the blank. A linkage connects the motor to the rotary fill slide. The motor drives the linkage in synchronization with the press cycle to fill the space during the period of time that the working element performs the operation on the blank.

7 Claims, 3 Drawing Sheets

ROTARY FILL MEMBER FOR A DIE ASSEMBLY

BACKGROUND OF THE INVENTION

1. Field of the Invention

The invention relates to a rotary fill member for a die assembly used in a press.

2. Background Art

A press is generally provided with a die assembly that is used to perform an operation on a blank, such as a sheet metal blank. The die assembly may have a movable component that is positioned by an air or hydraulic cylinder to back-up a portion of the blank. The movable component may be a rotary fill member that is shaped like a drum that includes a die forming surface that is rotated into position below the blank.

The cylinder is effective to position the movable assembly, but variations may be encountered in manufacturing plant operating conditions and with different dies and presses. These variations may include, but are not limited to, varying air line length, varying diameter of the air line supply to the air cylinder, varying air cylinder characteristics, and variations in plant air pressure or hydraulic pressure. These types of variables complicate adjusting of the actuation of the movable assembly by the air powered cylinder. To accommodate variations in timing, cycle times may need to be decreased which makes it more difficult to meet high speed production demands. Operational timing problems are exacerbated by the use of air powered cylinders with high speed presses.

Rotation of a rotary fill member between a fill position and a retracted position must be coordinated with loading and unloading the blank in the die. The blank must be loaded and unloaded at specific times to allow for transferring of the blank between operations. As press speeds increase, the time required to move between the fill position and the retracted position is shortened.

There is a need for a system for actuating a rotary fill member that can be used with increased stroke rates and higher speeds while producing high quality sheet metal parts. The embodiments disclosed below are directed to overcoming the above problems and other problems that will be apparent to one of ordinary skill in the art.

SUMMARY OF THE INVENTION

According to one aspect of the disclosure, a rotary fill slide assembly is provided for a sheet metal forming die that is operated by a press. The press has a timing controller that is based on a press cycle. The rotary fill slide assembly has a rotary motor that is controlled based on the timing controller of the press. The rotary fill slide is rotatably assembled to the die to fill a space adjacent to a portion of the blank when the blank is in position to perform a forming operation on the blank. A link connects the rotary motor to the rotary fill slide. The rotary motor drives the link in synchronization with the press cycle to fill the space during the period of time that the forming operation is performed on the blank.

According to another aspect of the disclosure, a die assembly for a metal forming press has a timing controller that operates the die assembly according to a press forming cycle. The die assembly has a die that includes a working component that performs a manufacturing operation on a blank in a timed relationship corresponding to a cycle of the press. A rotatable member is assembled to the die and a drive motor rotates the rotatable member relative to the die. A controller receives control signals from the timing controller. The control signals are used to control the drive motor to cause the rotatable member to periodically engage a portion of the blank on which the working component performs the manufacturing operation.

According to yet another aspect of the disclosure, a method of forming a blank includes loading a blank into a die of a forming press. The die has a rotary fill component that is retracted as the blank is loaded into the die. The press has a controller that generates a plurality of timing signals that are based on an operating cycle of the press. The method further includes actuating a motor in response to a first timing signal. The motor is operatively connected to the rotary fill component to rotate the rotary fill component into engagement with the blank. An area of the blank is operated on proximate the rotary fill component. The method further includes actuating the motor in response to a second timing signal to retract the rotary fill component out of engagement with the blank after the operating step after which the blank is unloaded from the die.

These and other features will be better understood in view of the attached drawings and the following detailed description of the illustrated embodiments.

DETAILED DESCRIPTION OF EMBODIMENTS OF THE INVENTION

Detailed embodiments are disclosed below but it is to be understood that the disclosed embodiments are merely examples of the invention that may be embodied in various and alternative forms. The figures are not necessarily to scale. Some features may be exaggerated or minimized to show details of particular components. The specific structural and functional details are not to be interpreted as limiting, but merely as a representative basis for the claims and to teach one skilled in the art how to practice the invention.

Figure 1:
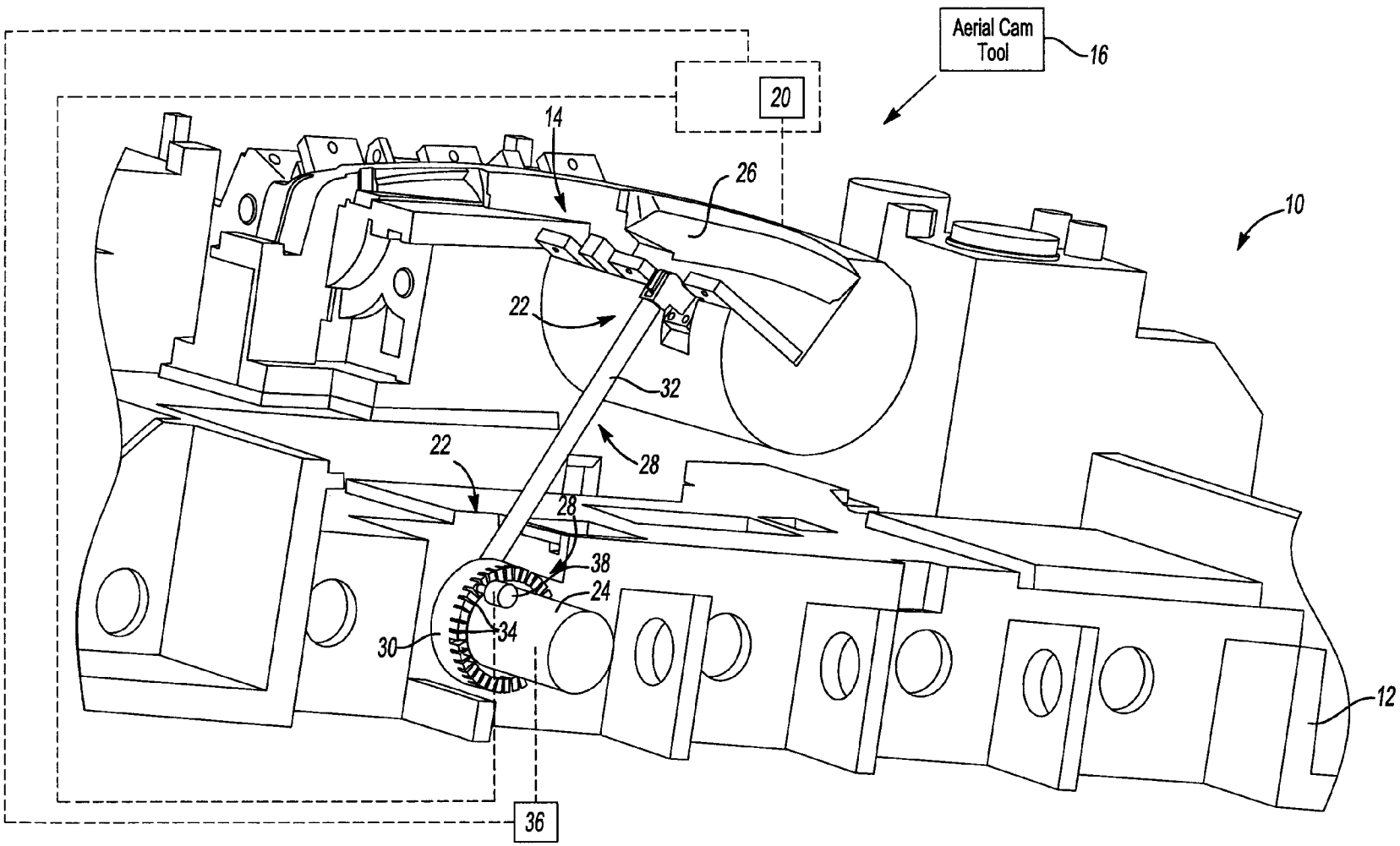
FIG. 1 is a side perspective view of a die assembly with a rotary fill slide assembly.

Referring to FIG. 1, a die assembly is illustrated and generally referenced by numeral 10. The die assembly 10 may be operated by any type of forming press including, but not limited to, a conventional single operation press, a transfer press, or a high speed transfer press. The die assembly 10 has a lower die 12 which is supported by the press bed of the press. The die assembly 10 is used to perform an operation on a sheet metal blank (as will be described below with reference to FIGS. 2-6), such as drawing, piercing, flanging, or the like. A movable working element 16 may be provided such as a cam that drives a flange tool, a piercing tool, a coining tool, a drawing tool, or the like. The working element 16 moves into engagement with the die assembly 10 to act upon the blank.

A press controller 20 may include a timing circuit or may be an external timer that is interfaced with the press controller 20. The press controller 20 provides one or more operational signals to the die assembly 10. These operational signals may include but are not limited to power signals, control signals and timing signals.

The die assembly 10 is provided with a rotary fill slide assembly 22. The rotary fill slide assembly 22 rotates to support the blank so that the working element 16 of the die assembly 14 can operate on the blank. The rotary fill slide assembly 22 may include a rotary motor 24, a rotary fill slide 26, and a link 28. The rotary motor 24 is mounted on the lower die 12 of the die assembly 10. The rotary fill slide 26 is rotatably connected to the die assembly 14. The link 28 connects the rotary motor 24 to the rotary fill slide 26.

Although the rotary motor 24, as depicted, is mounted on the lower die 12, the rotary motor 24 may be mounted in any suitable location on the upper die (not shown) or the die assembly 10. Any suitable motor 24 which provides a rotary motion output may be employed. In one embodiment, the motor 24 is a servo motor. The servo motor 24 may be powered in a variety of ways, such as electrically or electro-hydraulically for example.

In the embodiments depicted, the link 28 is collectively formed by a crank 30 and a rod 32. The crank 30 is connected to the rod 32 by a crank type connection that is not shown but is well known in the art and is similar to the connection of a connecting rod of an engine to a crankshaft. The crank 30 may be driven in an arcuate or in a rotary motion by the rotary motor 24. The arcuate or rotary motion provided by the crank 30 is converted to a generally linear motion of the rod 32 that moves the rotary fill slide 26 reciprocally.

The length of the rod 32 determines, in part, the degree of rotation of the rotary fill slide 26. The length of the rod 32 also determines the spacing between the crank 30 and a clevis connector 35 that is connected to the fill slide 26. In one embodiment, the rod 32 may be adjustable. If an adjustable rod 32 is provided, the rotation of the rotary fill slide 26 may be adjusted by changing the length of the rod 30. Alternatively, the rod 32 may be replaced with a rod 32 having a different length so that the degree of rotation of the rotary fill slide 26 may be varied. If the motor drives the crank in an arcuate motion, changes in the length of the rod 32 may be accommodated to a limited extend by changing the location of the connection to the crank 30. If a larger change in the length of the rod 32 is required or if the motor 24 drives the crank 30 in a rotary motion, changing the mounting location of the crank 30 on the die assembly 10 will be required.

In the illustrated embodiment, graduations 34 may be formed on the crank 30. The graduations 34 may be spaced apart to permit a user to measure the range of motion of the crank 30. The graduations 34 may be spaced apart in degrees, radians or any other units of radial intervals which are proportional or inversely proportional to one another. A sensor 38 may be assembled to one of the graduations 34 on the crank 30. The sensor 38 provides an indication of the rotational position of the crank 30. The sensor 38 is assembled to the crank 30 to track the rotation of the crank 30. The sensor 38 may be connected with the press controller 20 to provide a signal indicative of the rotational position of the crank 30. The rotational position of the crank 30 may be provided to the press controller 20 to coordinate the crank with the press cycle.

The rotary motor 24 of the rotary fill slide assembly 22 is controlled by a motor controller 36. The motor controller 36 may be connected to the timing mechanism of the press controller 20. The motor 24 is controlled by the motor controller 26 according to the timing of the press controller 20.

Figure 2:
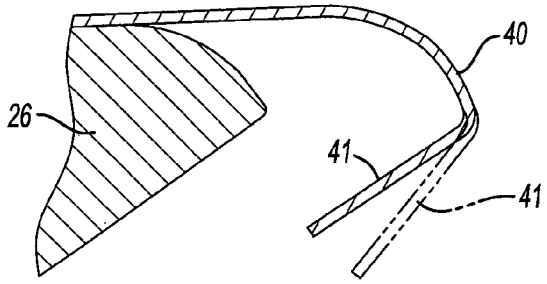
FIG. 2 is a diagrammatic view of the rotary fill slide shown retracted from a flange or a formed part and also illustrating in phantom the position of the flange prior to the forming step.

Referring to FIG. 2, a blank 40 is partially depicted in conjunction with part of the rotary fill slide 26 that engages the blank 40. The rotary fill slide 26 is shown in the retracted position after forming the blank 40. In this embodiment, the blank 40 has a flange 41 that is formed to a tighter angle by a flange tool or coining tool that may be retained on an aerial cam (not shown) or on another part of the die assembly 10. The flange 41 is initially formed in a previous operation to the position shown in phantom lines before the blank 40 is loaded into the die assembly 10.

Figure 3:
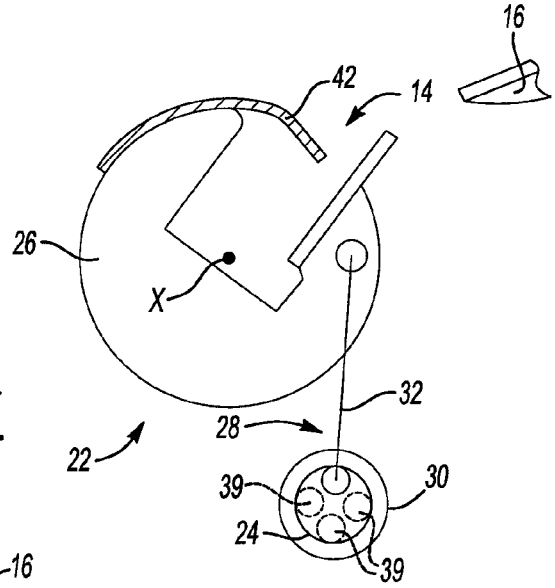
FIG. 3 is a schematic view of a rotary fill slide assembly on which a blank is loaded in a loading position before rotation of the rotary fill slide assembly to fill behind the blank.

FIGS. 3-6 diagrammatically illustrate the die assembly 10, the working element 16 and the rotary slide assembly 22. In FIG. 3, a partially formed blank 40 is loaded into the position on the die assembly 10. The unformed blank 40 may be any suitable size, shape or material within the scope of the disclosed embodiments. In one embodiment, the unformed blank 40 is made of sheet metal.

As shown in FIG. 3, the rotary fill slide 26 is in the retracted position which allows the unformed blank 40 to be easily loaded onto the die assembly 10. The unformed blank 40 may be moved into this position by a press loader that lifts the blank 40 with suction cups (not shown), for example.

Receptacles 39 may be provided on the crank 30 to connect the rod 32 to the crank 30 in a plurality of positions. Depending upon the position of the receptacle 39 in which the rod 32 is connected, the timing and range of movement of the rotary fill slide 26 can be adjusted.

Figure 4:
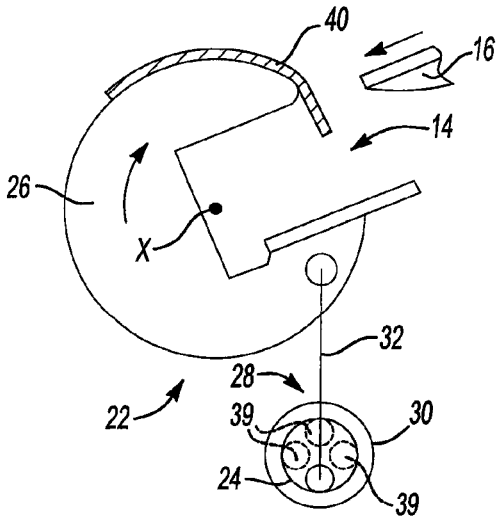
FIG. 4 is a schematic view of the rotary fill slide assembly of FIG. 3 in an intermediate position after the rotary fill slide assembly is moved to fill behind the blank.

Referring to FIG. 4, the rotary motor 24 and the crank 30 are rotated in the direction indicated by the arrow on the rotary fill slide. Rotating or pivoting of the crank 30 drives the rod 32 to partially rotate the rotary fill slide 26 about an axis X. The rotary fill slide 26 supports the blank 40 so that the working element 16 can operate on the partially formed blank 40 without deforming other parts of the blank 40.

Figure 5:
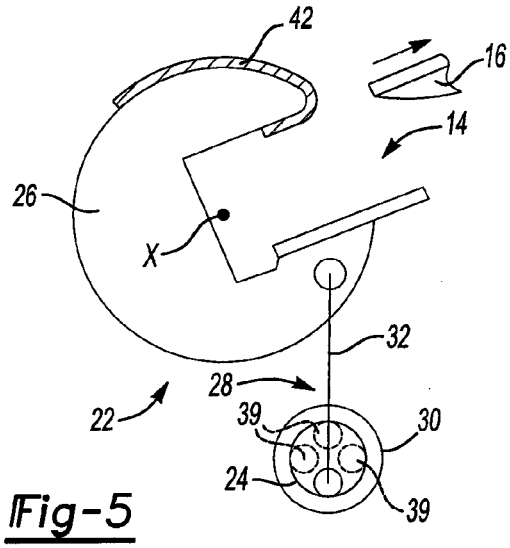
FIG. 5 is a schematic view of the rotary fill slide assembly of FIG. 3 in a forming position after the working element has acted upon the blank.

Referring to FIG. 5, the working element 16 of the die assembly 10 is actuated to operate on the partially formed blank 40 of FIG. 4. The partially formed blank 40 is converted to a formed blank 42. The working element 16 may move in the direction indicated by the arrow adjacent to the working element 16 to retract from the formed blank 42.

Figure 6:
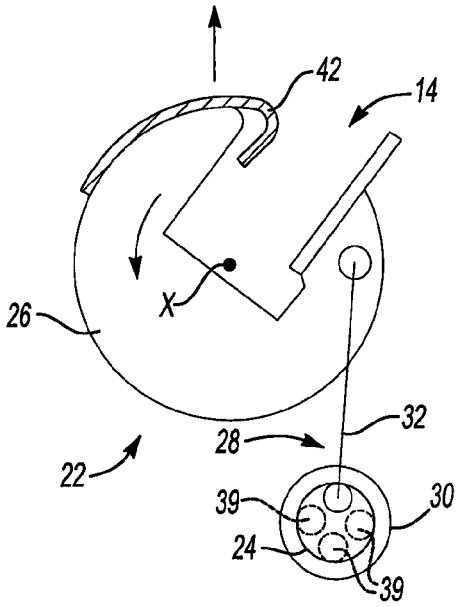
FIG. 6 is a schematic view of the rotary fill slide assembly of FIG. 3 in an unloading position.

Referring to FIG. 6, the fill slide 26 retracts by moving in the direction indicated by the arcuate arrow after the working element 16 has completed the operation on the formed blank 42. The motor 24 reverses direction to retract the crank 30, rod 32, and rotary fill slide 26. Alternatively, the motor 24 may rotate in one direction circularly to reciprocate the rod 32. The working element 16 moves to the retracted position as shown in FIG. 5 before the rotary fill slide 26 retracts. Once the working element 16 and the rotary fill slide 26 are retracted, the formed blank 42 is unloaded from the die assembly 10.

After the formed blank 42 is removed, the die assembly 10 is in the position depicted in FIG. 3 and is ready to receive another unformed blank 40. The steps shown in FIGS. 3-6 may then be repeated as described above. Operation of the rotary fill slide assembly is timed with the press controller which allows for increased operation speed and increased productivity.

Figure 7:
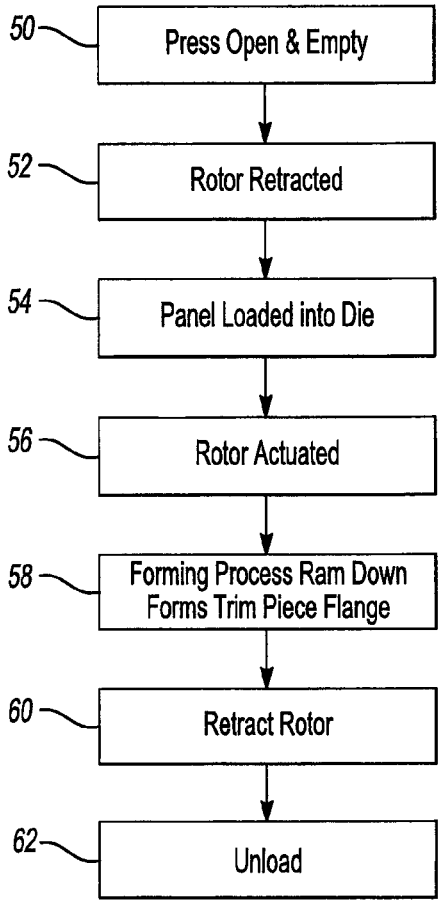
FIG. 7 is a flow chart that illustrates one example of a method of forming a part according to an embodiment of the invention.

Referring to FIG. 7, an example of an operation cycle of a press having a rotary fill slide assembly 26 operating in accordance with the invention is described. The cycle begins at 50 with the press open and no blank 40 in the die assembly 10. The rotary fill slide 26, or rotor, is in the retracted position at 52. A panel, or blank 40, is loaded into the die assembly 10 at 54. The rotor is actuated at 56 to back-up a desired area below or behind the panel 40. At 58, the press ram cycles to form the desired area on the panel, or blank 40, by flanging, piercing, coining, or otherwise operate on the blank 40. The rotor 26 is retracted at 60 which corresponds to the position of the rotor in step 52. Finally, the formed blank 42 is unloaded from the die assembly 10.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A rotary fill slide assembly for a sheet metal forming die that has a working element which performs an operation on a portion of a sheet metal blank, the die is operated by a press that has a timing mechanism that is based upon a press cycle, the rotary fill slide assembly comprising:

a rotary motor that is controlled based upon the timing mechanism of the press;

a rotary fill slide rotatably assembled to the die to fill a space adjacent to a portion of the blank when the blank is in position for the working element to perform the operation on the blank;

a link connecting the rotary motor to the rotary fill slide, wherein the link is a crank that is rotated by the motor and a rod that is connected on a first end to the crank and on a second end to the rotary fill slide; and wherein the rotary motor drives the link in synchronization with the press cycle to cause the rotary fill slide to fill the space during the period of time that the working element performs the operation on the blank.

2. The rotary fill slide assembly of claim 1 wherein the crank is a graduated crank that has a plurality of radially spaced connection points, and wherein the first end of the rod may be selectively secured to one of the connection points to establish a period during the press cycle when the rotary fill slide fills the space adjacent to the portion of the blank.

3. The rotary fill slide of claim 1 wherein the crank is arcuately pivoted by the motor, wherein the length of the rod may be changed and a connection point on the crank may be changed to accommodate change in the length of the rod.

4. The rotary fill slide of claim 1 wherein the rotary motor is a servo motor that is connected to a press controller, wherein the press controller includes the timing mechanism that controls the servo motor in response to timing signals that are generated by the press controller.

5. A rotary fill slide assembly for a sheet metal forming die that has a working element which performs an operation on a portion of a sheet metal blank, the die is operated by a press that has a timing mechanism that is based upon a press cycle, the rotary fill slide assembly comprising:

a rotary motor that is controlled based upon the timing mechanism of the press;

a rotary fill slide rotatably assembled to the die to fill a space adjacent to a portion of the blank when the blank is in position for the working element to perform the operation on the blank;

a link connecting the rotary motor to the rotary fill slide, wherein the link is a crank that is rotated by the motor and a rod that is connected on a first end to the crank and on a second end to the rotary fill slide;

wherein the rotary motor drives the link in synchronization with the press cycle to cause the rotary fill slide to fill the space during the period of time that the working element performs the operation on the blank; and wherein the link includes a rod that connects the rotary motor to the rotary fill slide, wherein the length of the rod connecting the motor to the slide can be adjusted to control the duration of time that the space is filled by the rotary fill slide, and wherein the spacing between the rotary motor and the rotary fill slide is modified to accommodate the change in the length of the rod.

6. A rotary fill slide assembly for a sheet metal forming die that has a working element which performs an operation on a portion of a sheet metal blank, the die is operated by a press that has a timing mechanism that is based upon a press cycle, the rotary fill slide assembly comprising:

a rotary motor that is controlled based upon the timing mechanism of the press;

a rotary fill slide rotatably assembled to the die to fill a space adjacent to a portion of the blank when the blank is in position for the working element to perform the operation on the blank;

a link connecting the rotary motor to the rotary fill slide, wherein the link is a crank that is rotated by the motor and a rod that is connected on a first end to the crank and on a second end to the rotary fill slide;

wherein the rotary motor drives the link in synchronization with the press cycle to cause the rotary fill slide to fill the space during the period of time that the working element performs the operation on the blank; and wherein the link comprises a graduated crank, and wherein a sensor is provided that senses the position of the crank and produces a signal indicative of the position of the crank to the timing mechanism of the press.

7. The rotary fill slide of claim 6 wherein the signal indicative of a position of the crank is used to adjust the timing when the rotary fill slide fills the space adjacent to the portion of the blank.

* * * * *